US005743152A

United States Patent [19]

Grüdl

[11] Patent Number: 5,743,152

[45] Date of Patent: Apr. 28, 1998

[54] CRANK ROD

[75] Inventor: Josef Grüdl, Löchgau, Germany

[73] Assignee: Gerhard Geiber GmbH, Germany

[21] Appl. No.: 697,139

[22] Filed: Aug. 20, 1996

Related U.S. Application Data

[63] Continuation of PCT/EP95/00542, Feb. 15, 1995.

[30] Foreign Application Priority Data

Jun. 8, 1994 [DE] Germany ..... 44 22 142.8

[51] Int. Cl.[6] ..... E04F 10/06

[52] U.S. Cl. ..... 74/545; 74/524; 464/106

[58] Field of Search ..... 74/545, 546, 547, 74/528, 529, 543, 523, 524, 525; 464/106, 128, 129, 112, 113; 403/17, 18, 52, 73, 53, 56; 160/66; 49/333, 335, 339, 341

[56] References Cited

U.S. PATENT DOCUMENTS

| | | | |
|---|---|---|---|
| 586,162 | 7/1897 | Cobb | 403/73 |
| 721,035 | 2/1903 | Griffin | 464/106 |
| 993,701 | 5/1911 | Messiter | 464/106 |
| 2,762,211 | 9/1956 | Bellomo | 464/142 |
| 3,840,061 | 10/1974 | Herms . | |
| 4,767,231 | 8/1988 | Wallis | 403/56 |
| 4,909,775 | 3/1990 | F'Geppert | 464/106 X |
| 5,033,433 | 7/1991 | Churchill et al. | 464/106 X |

FOREIGN PATENT DOCUMENTS

4216800A1 12/1993 Germany .

*Primary Examiner*—Charles A. Marmor
*Assistant Examiner*—Saul J. Rodriguez
*Attorney, Agent, or Firm*—Schweitzer Cornman Gross & Bondell LLP

[57] ABSTRACT

A winding rod which has an elongated part disposed substantially perpendicularly to its longitudinal axis and being rotatable about the axis, an annular eyelet having a curved inner face partially surrounding the rotatable part that has an enlarged portion having an outer face curved complimentarily to the inner face within at least a section for cooperating with the outer face and being substantially coaxially disposed within the eyelet, the inner face being adapted to accommodate the outer face therein; the annular eyelet that has a circular or oval cross-section, curved suitably convex opposed inner faces at each side of the eyelet and tapering in the direction of each other, and a central aperture between the opposed inner faces.

6 Claims, 4 Drawing Sheets

CRANK ROD

This is a continuing application of parent application PCT/EP95/00542, filed on Feb. 15, 1995.

FIELD OF THE INVENTION

The invention relates to a crank rod, or a winding rod for awnings, and an eyelet for such winding rods.

BACKGROUND OF THE INVENTION

Conventional winding rods such as for awnings, as are described in German Patent No. 4,216,800 Al, wherein the free end of the rod has a downwardly bent projection, the cylindrical part of the winding rod has the same diameter, and is in frictional pressure connection with the surfaces of two truncated cones. The desired rotatability of the eyelet is ensured, but the use of considerable force is required, especially when the angle is increased between the axis of rotation of the eyelet and the longitudinal axis of the winding rod. In such cases, the part can be undesirably displaced axially within the eyelet.

It is the main object of the present invention to eliminate that drawback of the known crank construction

SUMMARY OF THE INVENTION

That main object is achieved by the present invention where the force applied by the winding rod is substantially fully transmitted to the eyelet, regardless of the operational angle which the axis of rotation of the eyelet forms with the longitudinal axis of the winding rod. The mating configuration of the enlarged portions of the winding rod and the inner faces of the eyelet ensures that no displacement of the winding rod occurs from the eyelet. Rather, it rather forms a kind of universal joint in which the enlarged portions travel or roll along the inner faces of the eyelet with a degree of freedom, therefore, without being axially displaced.

Further advantages will become apparent from the following detailed description.

The present invention has enlarged portions provided with a space therebetween on opposite sides of an eyelet. The operational faces of the enlarged portions are suitably adapted to conform to the configuration of the operational faces of the eyelet. Particularly advantageously, the operational faces of the enlarged portions and the operational faces of the eyelets face one another and are configured to be complementary to one another. Because of the form-fitting between the operational faces of the eyelet and the faces, the enlarged portions do not slide axially within the eyelet and particularly the enlarged portions are guided in the groove-like faces of the eyelet.

In a particularly advantageous embodiment of the present invention, enlarged portions are spherical and the enlarged portions are suitably rotatably mounted on the rod for minimizing friction.

BRIEF DESCRIPTION OF THE DRAWING

The invention is explained more fully hereinafter, with reference being made to the drawing, wherein.

DETAILED DESCRIPTION

Figure 2:
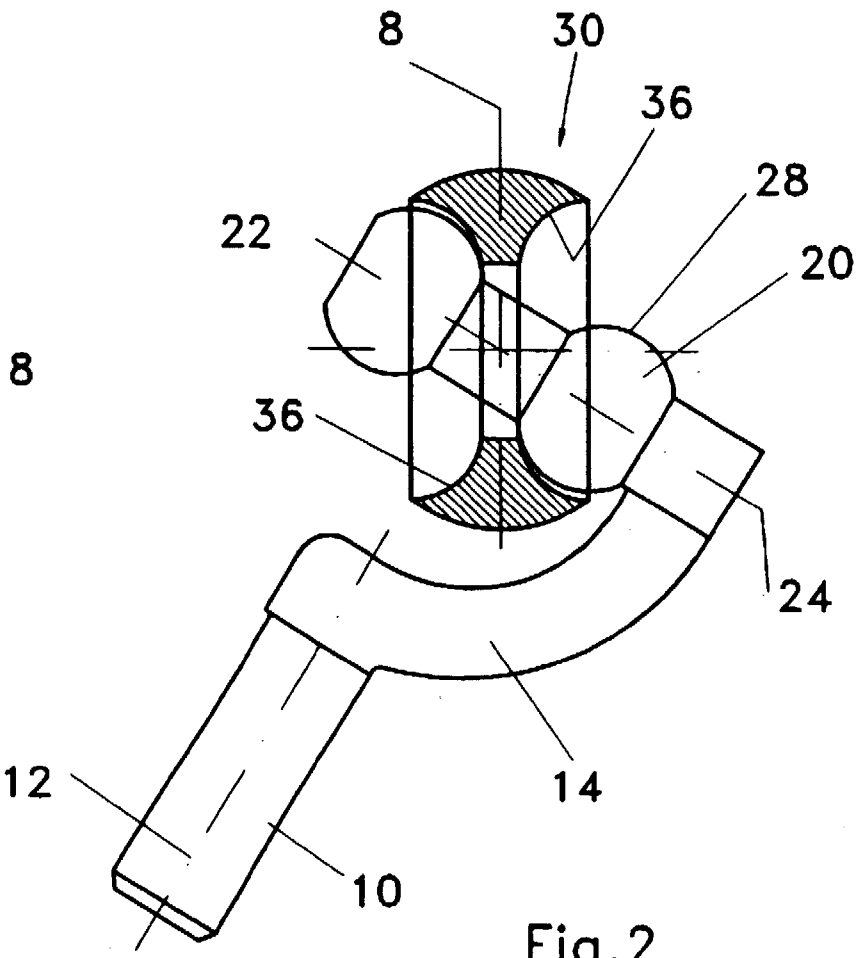
FIG. 2 illustrates the winding rod shown in FIG. 1 in an inclined operational position.
Figure 1:
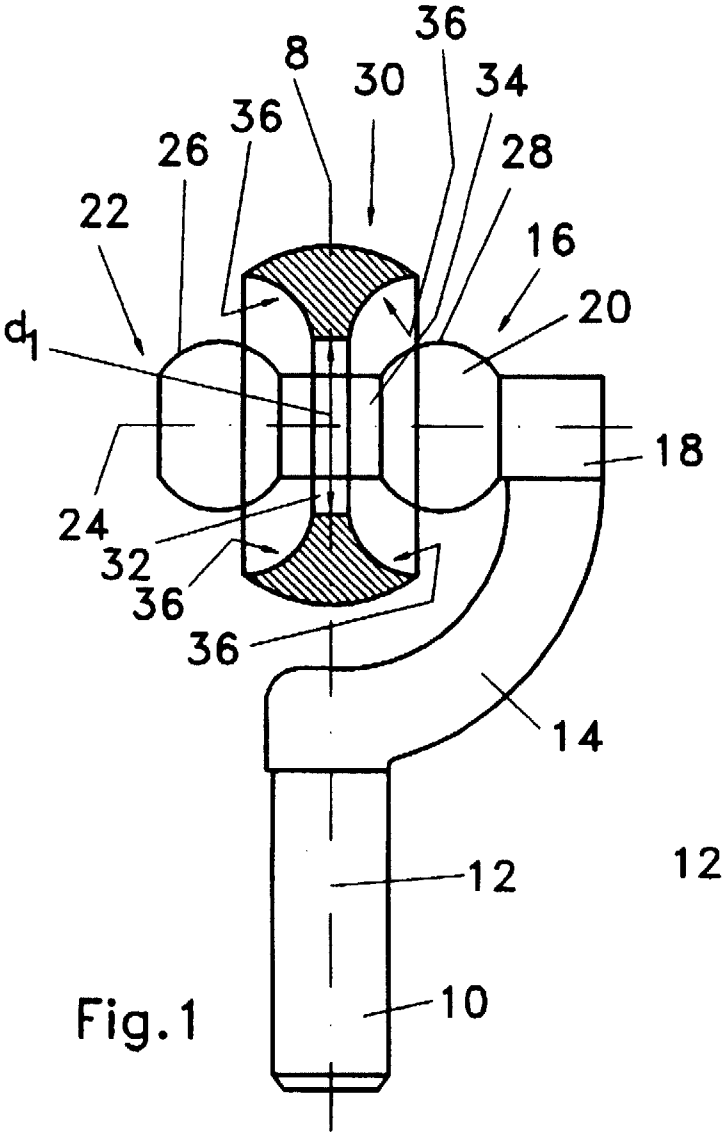
FIG. 1 is a cross-sectional view through an eyelet together with the end piece of a winding rod.
Figure 3:
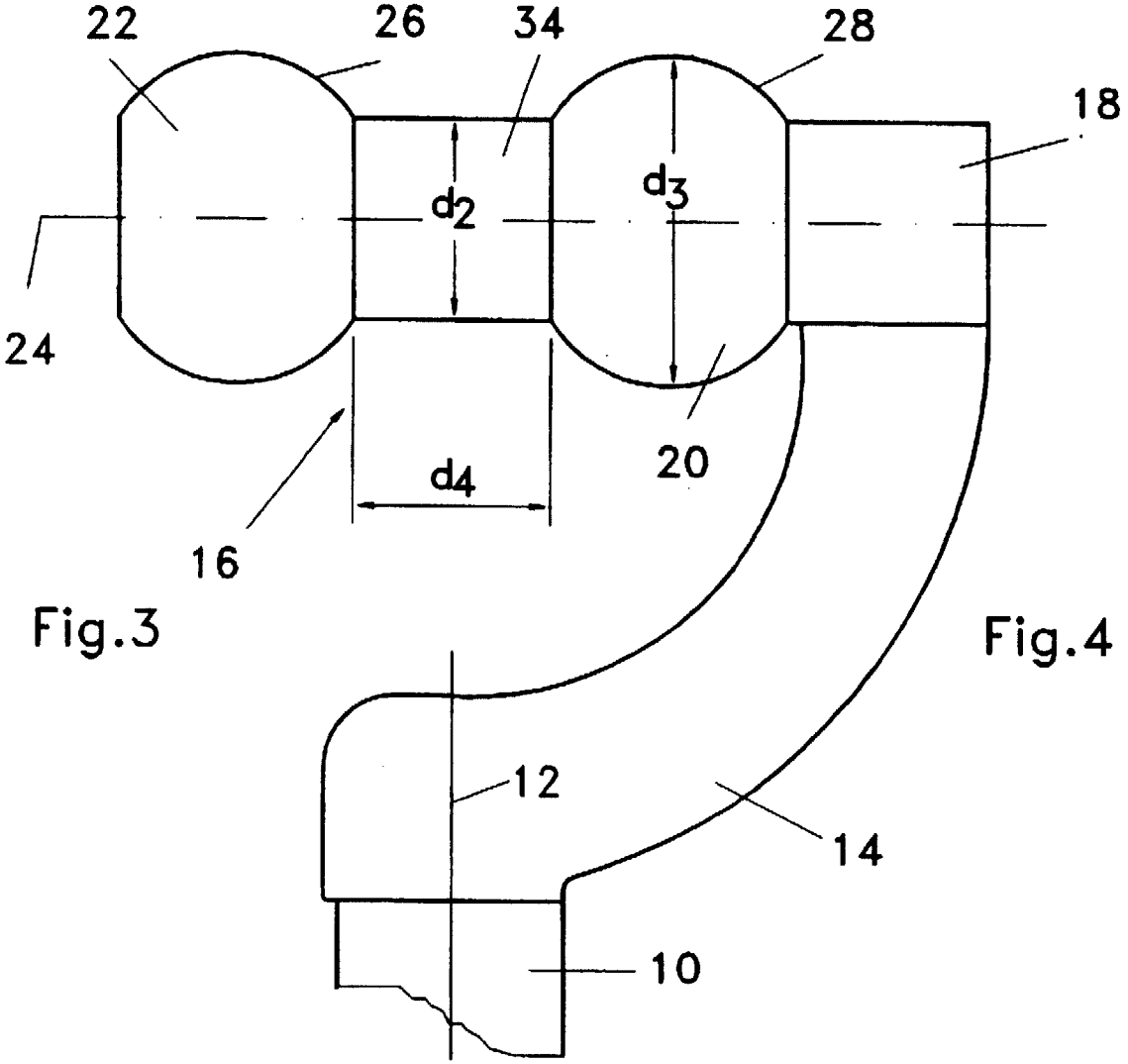
FIG. 3 is an enlarged view of the upper end of the winding rod of FIG. 1.
Figure 6:
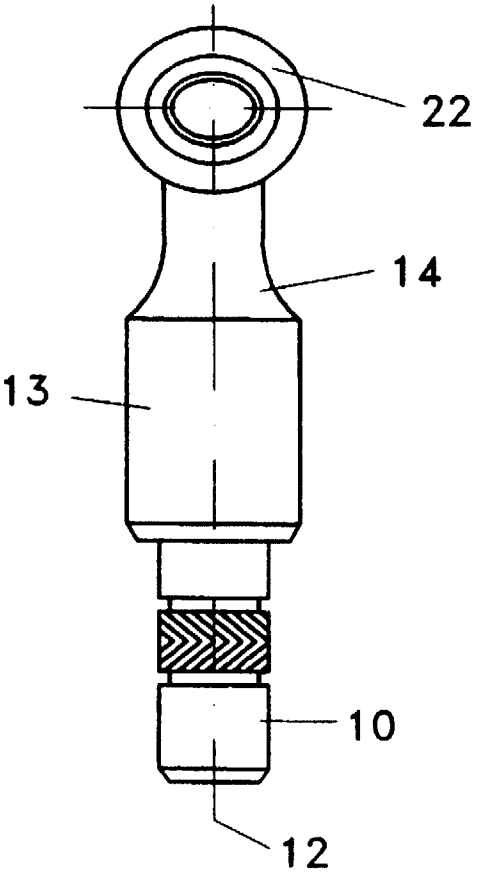
FIG. 6 is a side view taken in the direction of the arrow VI of FIG. 5.

FIGS. 1–3 illustrate a winding rod 10, having a part 16, which is rotatable about the longitudinal axis 12 of the rod. The rotatable part 16 extends transversely to the longitudinal axis 12, for actuating an eyelet 30 having an aperture 32. The aperture of the eyelet 30 has a circular inner configuration and two substantially frustoconical, rotationally symmetrical faces 36, which are disposed coaxially with each other and terminate in the common aperture 32 via their ends that face one another. The rotatable part 16 is provided with an enlarged portion 22 and is insertable in the aperture 32. The rotatable part 16 also has a second enlarged portion 20, so that each of the enlarged portions 20 and 22 can cooperate with one of the inner faces 36, as can be best seen in FIG. 2, with the enlarged portions 20 and 22 conforming to the configuration of the faces 36. The distance d4 can be kept quite small, if necessary, so that only a gap having the cross-sectional form of a double rocker arm is formed between the enlarged portions 20 and 22. The enlarged portions can be chamfered. The parts of the operating faces 26 and 28 are convex and of the faces 36, facing one another, are configured to be complementary to one another.

In the described embodiment of the present invention, the operational faces 26 and 28 are convex and the faces 36 are concave, and this permits the easy and rapid manufacture of the enlarged portions and the eyelet, e.g., by casting or injection-molding. The enlarged portions 20 and 22 are suitably configured in the shape of spherical portions, the external diameter of the spherical portions being slightly smaller than the internal diameter d1 of the eyelet 30. Furthermore, the enlarged portions 20 and 22 are disposed symmetrically relative to the longitudinal axis 12, so that an optimum transmission of force can be effected from the winding rod 10 to the eyelet 30. Furthermore, the drawing reveals that the enlarged portions 20 and 22 are formed integrally with the rotatable part 16, so that they could generally also be mounted to rotate about the longitudinal axis 24 of the rotatable part. The rotational axis 8 of the eyelet can form an angle of up to 45° with the longitudinal axis of 12 of the winding rod.

The eyelet 30 is a symmetrical body with respect of its axis of rotation 8, having a circular aperture 32. The inner faces 36 are curved inwardly and taper towards the aperture 32. Geometrically, these faces 36 are surfaces of a spherical truncated cone, with arcuate generatrices. The base lines 33 (FIG. 4) of this truncated cone are remote from one another.

The central portion 34 of the part 16 has a circular cross-section and centrally traverses the aperture 32. The rotatable part 16 is connected to the winding rod 10 through an arcuate portion 14 and an endpiece 18.

Figure 4:
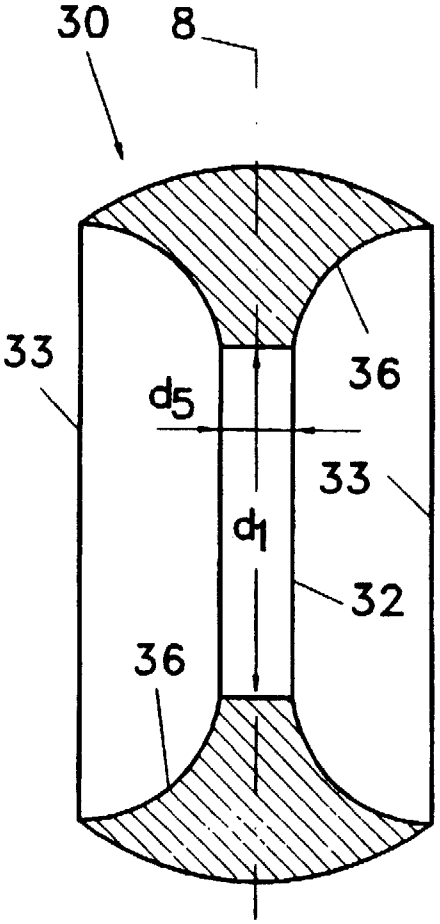
FIG. 4 is an enlarged view of the eyelet of FIG. 1.

As best shown in FIGS. 3 and 4, the external diameter d3 of the enlarged portion is substantially as large as the internal diameter d1 of the eyelet, the diameter d2 of the central portion 34 being distinctly smaller than the internal diameter d1. The length d5 of the aperture 32, when viewed in the direction of the rotatable part 16, is distinctly smaller than the length d4 of the cylindrical central portion 34, so that the rotatable part 16 can be so inclined in the aperture 32 that the faces which are in contact cooperate with one another in a form-fitting manner, as can also more especially be seen in FIG. 2. The longitudinal axis 24 of the rotatable part 16 extends perpendicularly to the axis 12 of the winding rod 10. Generally, these two axes 12 and 24 may also form a larger or smaller angle.

Figure 7:
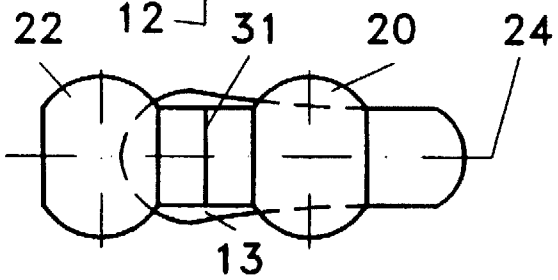
FIG. 7 is a view taken in the direction of arrow VII of FIG. 5.
Figure 5:
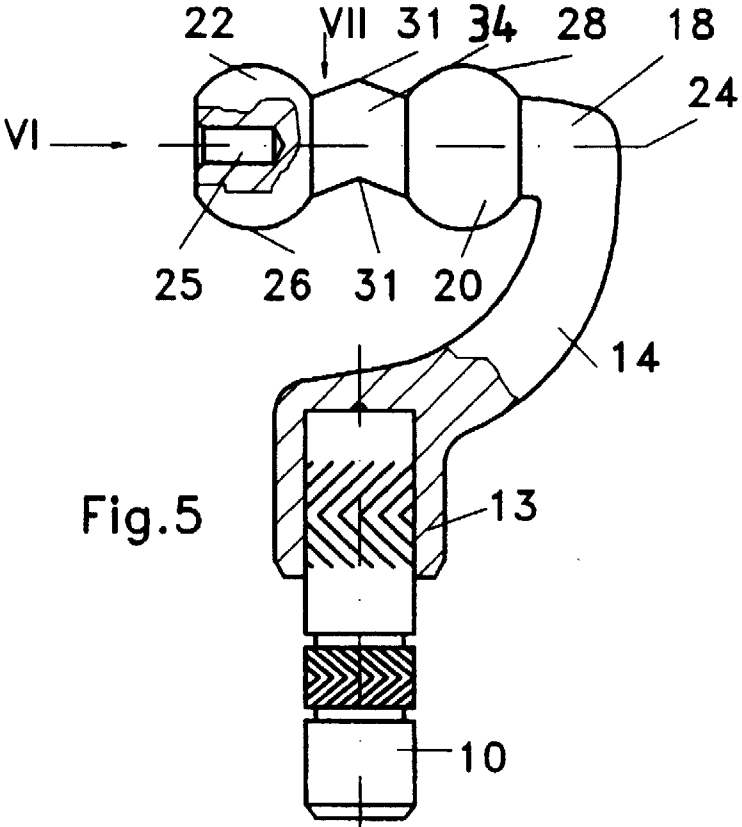
FIG. 5 illustrates a portion of another embodiment of a winding rod.

As best shown in FIGS. 5 and 7, the central portion 34 can be bent, and in that case its raised portion 31' or indentation 31 respectively is so configured that the central portion 34 can be suspended in the aperture 32. The enlarged portions 20 and 22 have an elliptical cross-section, as can be best seen in FIGS. 5 and 7.

An aperture 25 provided in the enlarged portion 22 is used for a set screw, not fully shown, and part 13 has a central bore in the central portion 34 to accommodate the endpiece of the winding rod.

Figure 8:
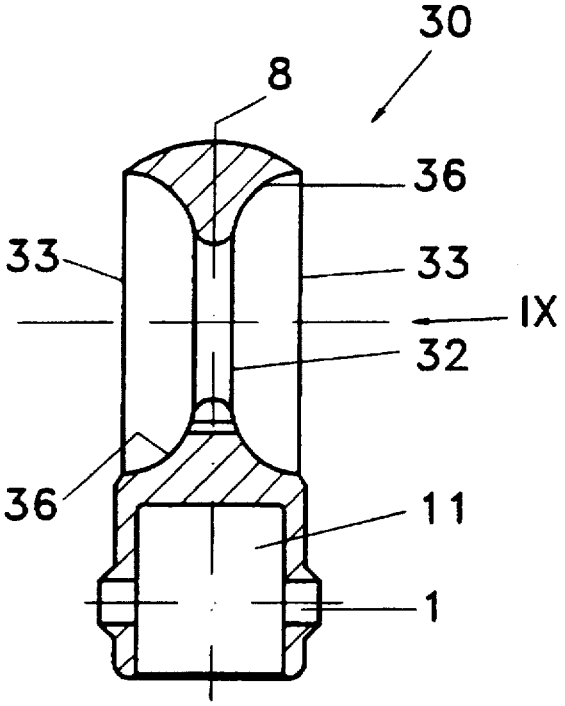
FIG. 8 is a cross-sectional view of an eyelet of another embodiment.
Figure 9:
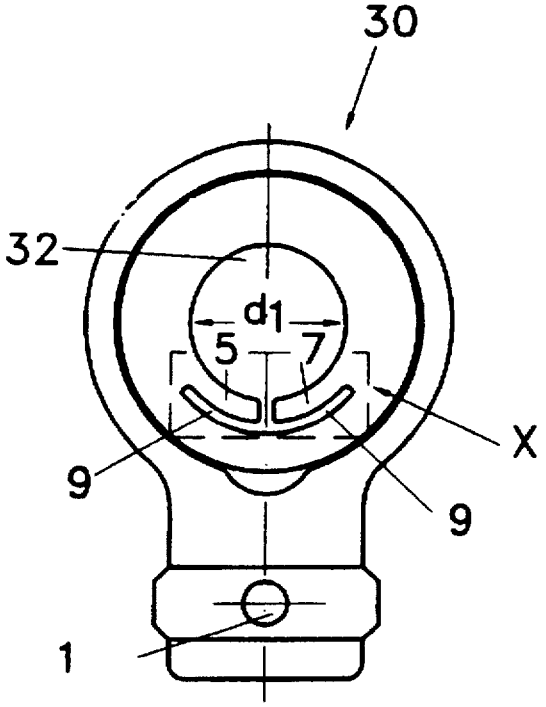
FIG. 9 is a view taken in the direction of arrow IX of FIG. 8.
Figure 10:
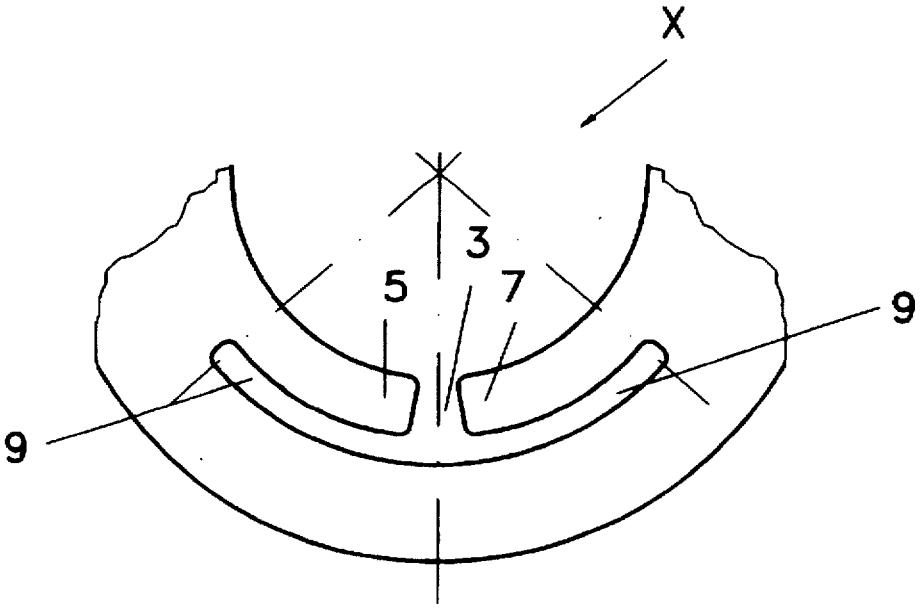
FIG. 10 is an enlarged view of the portion of FIG. 9 marked X.

A special feature of the alternative embodiment of the eyelet 30, as best shown in FIGS. 8 to 10, is that the internal diameter d1 of the eyelet, when it is in its nontensioned state, is smaller than the external diameter of the enlarged portion 22. The actual opening of the aperture 32 is configured so that it is provided with resilient flanges 5 and 7, which can be bent in the direction of a groove 9 separating the flanges from the eyelet. The advantage of this alternative structure lies in the fact that the enlarged portion 22 can be urged through the aperture 32 with minimum resistance, and the winding rod cannot be simply removed from the eyelet 30. To achieve such removal, a force has to be applied that is sufficiently large to bend the flanges 5 and 7 as may be necessary. A slot 3 is provided between the flanges 5 and 7 to permit the easy bending of the flanges 5 and 7. The eyelet 30 can suitably be an injection-molded component formed from an impact-resistant plastic and has an axial recess 11 for the insertion of a drive shaft (not shown) and can be connected by a pin 1 to such a drive shaft.

I claim:

1. A winding rod which comprises an elongated part having two enlarged portions separated by a smaller cross-section portion disposed substantially perpendicularly to the longitudinal axis of said elongated part and being rotatable about the axis, said enlarged portions each having a spherical or elliptical outer faces disposed within an eyelet having two opposed inner faces shaped complimentarily to said outer faces, said annular eyelet having a curved inner face partially surrounding said part, said part having an enlarged portion having an outer face curved complimentarily to said inner face within at least a section for cooperating with said outer face and being substantially coaxially disposed within said eyelet, said inner face being adapted to accommodate said outer face therein.

2. The winding rod of claim 1, wherein said smaller cross-section portion has a substantially cylindrical cross-section.

3. The winding rod of claim 1, wherein said smaller cross-section portion is straight and is substantially coaxial with the longitudinal axis.

4. The winding rod of claim 1, wherein the length of said smaller cross section portion is the distance between said enlarged portions, being determined by contact between the outer face of one enlarged portion with the inner face of said eyelet at one side from the longitudinal axis, and between the outer face of the other enlarged portion with the inner face of said eyelet at the opposed side from the longitudinal axis, when the longitudinal axis and the centerline of said eyelet are disposed at their maximum angle relative one another.

5. The winding rod of claim 1, wherein said enlarged portions are disposed symmetrically to each other at each end of said smaller cross-section portion.

6. The winding rod of claim 1, wherein said enlarged portions are formed integrally with said smaller cross-section portion.

* * * * *

UNITED STATES PATENT AND TRADEMARK OFFICE

CERTIFICATE OF CORRECTION

PATENT NO. : 5,743,152
DATED : April 28, 1998
INVENTOR(S) : Joseph Grudl

It is certified that error appears in the above-indentified patent and that said Letters Patent is hereby corrected as shown below:

Title page, item [73], Assignee: should read --Gerhard Geiger GmbH, Germany--.

Signed and Sealed this

Twenty-eighth Day of July, 1998

*Attest:*

*Attesting Officer*

BRUCE LEHMAN

*Commissioner of Patents and Trademarks*